US009738437B2

(12) United States Patent
Hui et al.

(10) Patent No.: US 9,738,437 B2
(45) Date of Patent: Aug. 22, 2017

(54) PORTABLE CHARGEABLE SPRAY BOTTLE

(71) Applicant: DONGGUAN YIXIN MAGNETIC DISK CO., LTD., Dongguan (CN)

(72) Inventors: Yi Ming Hui, Guangdong (CN); Zhi Wang, Guangdong (CN)

(73) Assignee: DONG-GUAN YIXIN MAGNETIC DISC CO., LTD, Guangdong (CN)

( * ) Notice: Subject to any disclaimer, the term of this patent is extended or adjusted under 35 U.S.C. 154(b) by 87 days.

(21) Appl. No.: 14/658,644

(22) Filed: Mar. 16, 2015

(65) Prior Publication Data

US 2015/0183572 A1 Jul. 2, 2015

Related U.S. Application Data

(63) Continuation of application No. 13/168,693, filed on Jun. 24, 2011, now Pat. No. 8,978,938, which is a continuation-in-part of application No. PCT/CN2009/072347, filed on Jun. 19, 2009.

(51) Int. Cl.

| | |
|---|---|
| ***B65D 83/00*** | (2006.01) |
| ***B65D 83/42*** | (2006.01) |
| ***B05B 11/00*** | (2006.01) |
| ***B65D 83/20*** | (2006.01) |

(52) U.S. Cl.

CPC ..... *B65D 83/42* (2013.01); *B05B 11/0018* (2013.01); *B05B 11/0056* (2013.01); *B65D 83/207* (2013.01); *B05B 11/0097* (2013.01)

(58) Field of Classification Search

CPC ... B65D 83/42; B65D 83/207; B05B 11/0018; B05B 11/0056; B05B 11/0097; B05B 11/0005; B05B 11/0024; B05B 11/0035; B65B 31/00

USPC ..... 222/402.16, 188; 141/2, 3, 5, 18, 20, 141/113; 215/2

See application file for complete search history.

(56) References Cited

U.S. PATENT DOCUMENTS

| | | | | |
|---|---|---|---|---|
| 3,108,721 A * | 10/1963 | Nebinger | A47J 43/121 222/402.16 |
| 3,559,701 A * | 2/1971 | Wittersheim | B65D 83/14 137/588 |
| 3,601,164 A | 8/1971 | Bruce | |
| 3,718,165 A * | 2/1973 | Grothoff | B65B 3/04 137/583 |
| 4,197,884 A | 4/1980 | Maran | |
| 4,473,097 A | 9/1984 | Knickerbocker et al. | |
| 4,750,532 A | 6/1988 | Grothoff | |

(Continued)

FOREIGN PATENT DOCUMENTS

| | | |
|---|---|---|
| CN | 2114634 U | 9/1992 |
| CN | 201055827 Y | 5/2008 |

(Continued)

*Primary Examiner* — J. Casimer Jacyna
*Assistant Examiner* — Benjamin R Shaw
(74) *Attorney, Agent, or Firm* — William Dippert; Laurence Greenberg; Werner Stemer

(57) ABSTRACT

A portable chargeable spray bottle is disclosed comprising a body comprising an upper part and a lower part; a spray nozzle assembly equipped on the upper part, and a liquid charging structure placed at the bottom part. It is further comprises an exhaust structure comprising an exhaust hole penetrating the body, whereby exhaust air flow can escape via the exhaust hole to outside the bottle.

8 Claims, 14 Drawing Sheets

(56) References Cited

U.S. PATENT DOCUMENTS

| | | | | |
|---|---|---|---|---|
| 4,877,065 | A | 10/1989 | Lamboy et al. | |
| 4,988,017 | A | 1/1991 | Schrader et al. | |
| 5,524,680 | A * | 6/1996 | de Laforcade | B05B 11/0037 141/113 |
| 5,623,974 | A * | 4/1997 | Losenno | B05B 9/0805 137/511 |
| 5,638,992 | A | 6/1997 | Lim et al. | |
| 5,791,527 | A | 8/1998 | Giuffredi | |
| 5,865,350 | A | 2/1999 | Losenno et al. | |
| 6,016,934 | A * | 1/2000 | Moriguchi | B65D 83/42 222/1 |
| 6,354,469 | B1 * | 3/2002 | Pozzi | B05B 11/0018 222/189.09 |
| 6,435,231 | B1 | 8/2002 | Cooper et al. | |
| 6,533,482 | B1 | 3/2003 | Byun | |
| 6,607,012 | B2 | 8/2003 | Yquel | |
| 6,857,806 | B2 | 2/2005 | Harrison et al. | |
| 6,883,564 | B2 | 4/2005 | Risch et al. | |
| 7,377,296 | B2 | 5/2008 | Gueret | |
| 7,665,635 | B2 | 2/2010 | Ramet et al. | |
| 8,079,388 | B2 | 12/2011 | Turgeman | |
| 2002/0057938 | A1 | 5/2002 | Gueret | |
| 2005/0211731 | A1 * | 9/2005 | Ramet | B05B 11/0051 222/321.9 |
| 2005/0284891 | A1 * | 12/2005 | Ramet | B05B 11/3023 222/321.7 |
| 2007/0041774 | A1 | 2/2007 | Tourigny | |
| 2009/0014481 | A1 | 1/2009 | Benetti | |
| 2009/0194191 | A1 * | 8/2009 | Turgeman | A45D 34/02 141/18 |
| 2011/0259923 | A1 * | 10/2011 | Chan | B65D 83/42 222/402.1 |
| 2011/0297275 | A1 | 12/2011 | Farrar et al. | |
| 2011/0309113 | A1 * | 12/2011 | Hui | B05B 11/0056 222/402.16 |
| 2012/0090730 | A1 * | 4/2012 | Dumont | A45D 34/02 141/2 |
| 2012/0312843 | A1 * | 12/2012 | Dumont | B05B 11/0056 222/321.9 |
| 2013/0078025 | A1 * | 3/2013 | Turgeman | B41J 2/17513 401/258 |
| 2014/0175128 | A1 * | 6/2014 | Croibier | B05B 11/0097 222/321.1 |

FOREIGN PATENT DOCUMENTS

| | | | |
|---|---|---|---|
| DE | 1166225 | | 9/1958 |
| DE | 1798193 | | 10/1959 |
| DE | 18026892 | | 12/1959 |
| DE | 1823268 | | 12/1960 |
| DE | 1968728 | | 9/1967 |
| DE | 2540876 | | 9/1975 |
| DE | 8307900 | U1 | 9/1983 |
| EP | 1283180 | A2 | 2/2003 |
| FR | 2073087 | | 9/1971 |
| FR | 2698341 | A1 | 11/1992 |
| FR | 2893598 | A1 | 11/2005 |
| GB | 938331 | | 11/1959 |
| GB | 5095103 | | 9/1982 |
| GB | 2137181 | A | 2/1984 |
| GB | 2229380 | | 9/1990 |
| JP | 5125605 | | 8/1976 |
| JP | 8175578 | A | 7/1996 |
| JP | 2004182305 | A | 7/2004 |
| WO | 0243794 | A1 | 6/2002 |

* cited by examiner

PORTABLE CHARGEABLE SPRAY BOTTLE

CROSS-REFERENCE TO RELATED APPLICATIONS

This application is a continuation of co-pending U.S. patent application Ser. No. 13/168,693, filed Jun. 24, 2011, which in turn is a continuation-in-part of PCT Patent Application No. PCT/CN2009/072347, filed Jun. 19, 2009, which is based upon Chinese Patent Application No. 20082026225.2, filed Dec. 26, 2008, the benefit of the priority of the filing date of each patent application is claimed herewith and which patent applications are incorporated herein by reference.

BACKGROUND OF THE INVENTION

Technical Field

The present invention relates to a spray bottle which can carry and spray liquid, and more especially, to a portable chargeable spray bottle.

Description of Related Art

Currently, the well-known portable spray bottle comprises a nozzle assembly, a bottle and an enclosure. The majority of spray bottles are used only once and thrown away when the liquid is used up. Though charging bottles with charging accessories appear in the market, they are complex, easy to spill and leak, and inconvenient. The current spray bottles made from plastic or glass causes environmental pollution when they are thrown away. Besides, for manufacturers and consumers, disposable goods are uneconomical, resulting in the waste of productive materials. Another problem is that the large bottles are inconvenient to carry if they are used by consumers on the go.

BRIEF SUMMARY OF THE INVENTION

According to one aspect, a portable chargeable spray bottle is provided, comprising:

a body comprising an upper part and a lower part;

a spray nozzle assembly equipped on the upper part, and a liquid charging structure placed at the bottom part, and an exhaust structure comprising an exhaust hole penetrating the body, whereby exhaust air flow can escape via the exhaust hole to outside the bottle.

In some embodiments a bottom part of the bottle is configured to incorporate part of the exhaust structure.

In some embodiments, the liquid charging structure comprises:

a stepped liquid charging mouth at the bottom of bottle;

a protuberant grooved piston equipped on the liquid charging mouth, and a resetting structure of piston, wherein a liquid charging passage is arranged on the piston and is fitted with a discharging opening.

Optionally a stop block with one flared end is equipped on the top of piston, a first sealing ring capable of performing sealing being arranged on the stop block.

In some of the embodiments having a stepped liquid charging mouth at the bottom of bottle and a protuberant grooved piston, the exhaust structure includes:

an exhaust hole equipped on the lower part of the bottle which corresponds to the piston groove, an air duct interconnected with exhaust hole and extending to the upper part of bottle, and a gap between the piston and an invagination of the bottle in which the piston is disposed, whereby at uncharged state the sealing ring blocks the gap from the duct.

A dynamic sealing may be formed by the exhaust hole and a second sealing ring in the groove of the piston.

In some embodiments, the exhaust structure comprises an exhaust hole equipped on the lower part of bottle and an air duct interconnected with exhaust hole and extending to upper part of bottle, wherein a gasket is equipped at the bottom of the exhaust hole.

The gasket may comprise silicon rubber.

The gasket may further comprise at least one pore extending therethrough, whereby pressurized air inside the bottle impels the pores to have a radial extension, such that the pores are enlarged and the pressurized air can be drained away via the exhaust hole, and when exhaust is complete, the gasket resets to block and seal the exhaust hole.

In some embodiments, the liquid charging structure comprises: a liquid charging mouth at the bottom of the bottle, a spring and a bead, the spring configured to urge the bead thereby sealing off the interior of the bottle from the charging mouth, and to be elevated when filling the bottle, the bead no longer blocking the charging mouth and thereby allowing liquid into the bottle, and the exhaust structure comprises: an exhaust hole equipped on the lower part of the bottle, and an air duct interconnected with exhaust hole and extending to the upper part of bottle, wherein a bead is equipped at the bottom of the exhaust hole and on a compression spring, and the compression spring is set on the lower part of bottle.

In some embodiments, the liquid charging structure comprises: a liquid charging mouth at the bottom of the bottle, and a piston comprising a bottom pliable and resilient part and a top hard part to which the bottom pliable part is permanently attached, whereby the bottom pliable part, when not forced upward, seals off the interior of the bottle from the charging mouth, and when forced upward, the bottom pliable part is compressed, allowing liquid to enter the bottle via at least one gap between the piston and a wall of the bottle defining the charging mouth.

The exhaust structure in such embodiments may comprise an exhaust hole equipped on the lower part of bottle and an air duct interconnected with the exhaust hole and extending to upper part of bottle, wherein a gasket is equipped at the bottom of the exhaust hole.

The gasket may comprise silicon rubber.

The gasket may further comprise at least one pore extending therethrough, whereby pressurized air inside the bottle impels the pores to have a radial extension, such that the pores are enlarged and the pressurized air can be drained away via the exhaust hole, and when exhaust is complete, the gasket resets to block and seal exhaust hole.

In some embodiments the nozzle assembly comprises: a gasket, a sprayer cap, and a pump with a pump core wall; between the cap and the pump core wall there being a gap, which extends from the gasket to inside the bottle, whereby exhaust air flow can escape via the gap and exhaust hole to outside the bottle.

The gasket may comprise silicon rubber.

The gasket may further comprise at least one pore extending therethrough, whereby pressurized air inside the bottle impels the pores to have a radial extension, such that the pores are enlarged and the pressurized air can be drained away via the exhaust hole, and when exhaust is complete, the gasket resets to block and seal exhaust hole.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. In case of conflict, the patent specification, including definitions, will control. In addition, the materials, methods, and examples are illustrative only and not intended to be limiting.

Unless marked as background or art, any information disclosed herein may be viewed as being part of the current invention or its embodiments.

The technical problem to be solved by the present invention is to provide a portable chargeable spray bottle which is easy to carry, features simple operation and quick charging, and bears certain negative pressure. To address the aforesaid technical problems, the present invention adopts the following technical solution:

The portable chargeable spray bottle comprises a bottle and a nozzle assembly installed on the upper part of the bottle. The liquid charging structure equipped at the bare bottom of the bottle includes a stepped liquid charging mouth located at the bottom of the bottle, a protuberant piston equipped on the liquid charging mouth and a piston resetting structure. The piston is provided with a liquid charging passage and a discharging opening is arranged on the top of the liquid charging passage. A stop block with one flared end is equipped on the top of piston. The first sealing ring capable of performing static sealing is arranged on the stop block. The piston is provided with a groove at the bottom in which the second sealing ring is equipped. A compression spring resetting the piston is fitted on the piston. As well, the spring is equipped between the first step surface of stepped liquid charging mouth and that of protuberant piston. The piston is pushed downwards by the spring and the stop block is driven to compress the first sealing ring to perform static sealing towards the bottle.

The bottom of the piston is provided with a concave surface on which the third sealing ring used to prevent liquid from leaking during liquid charging is equipped. An exhaust structure is available in the bottle.

Embodiment 1

The exhaust structure includes an exhaust hole 16 equipped on the upper part of side wall of the bottle. The exhaust hole 16 is interconnected with the outside by penetrating side wall of the bottle.

Embodiment 2

The exhaust structure includes an exhaust hole 26 equipped on the lower part of the bottle which corresponds to the groove of piston, and an air duct interconnected with exhaust hole 26 and extending to upper part of the bottle. Obviously, the independent or simultaneous use can be adopted for exhaust. The dynamic sealing is formed by the second sealing ring in the groove at the bottom of piston and exhaust hole. That is, when charging, the second sealing ring moves upwards driven by the piston and separates from exhaust hole 26, so that, the air duct is directly connected with atmosphere; the second sealing ring is compressed in the exhaust hole 26 in normal status, and the air duct is blocked from atmosphere, thus forming sealing.

Embodiment 3

The exhaust structure includes an exhaust hole 36 equipped on the lower part of the bottle, and an air duct interconnected with exhaust hole C and extending to upper part of the bottle. A silicon rubber gasket is equipped at the bottom of the exhaust hole 36. In order to exhaust the air, various pores are arranged on the silicon rubber gasket along the axis. For another realization mode of this embodiment, the silicon rubber gasket is equipped on the top of nozzle assembly installed on the upper part of the bottle, wherein various pores are arranged on the silicon rubber gasket.

Embodiment 4

The exhaust structure includes an exhaust hole 46 equipped on the lower part of bottle, and an air duct is interconnected with exhaust hole 46 and extends to upper part of bottle. A bead is equipped on the lower part of the exhaust hole 46 and on the compression spring which is set on the lower part of the bottle.

The reverse buckling or threaded connection can be adopted for the nozzle assembly installed on the upper part of the bottle, which is beneficial to sealing and hard to loosen. It is possible to use other connection modes in other embodiments.

In consideration of aesthetic perception, the bottle can be equipped with a decorative enclosure. The exhaust structure described in the present invention is not limited to the abovementioned liquid charging structure. It can be applied in the charging bottle of different liquid charging structures in other embodiments.

With the abovementioned structures, the spray bottle is convenient for carrying and can be reused, thus reducing the waste of resources. The user can quickly charge the spray bottle through charging structure instead of throwing it away once the liquid in the bottle is used up. Consequently, it can save the cost and protect the environment. In addition, the exhaust structure arranged in the present invention can ensure that it can bear certain negative pressure and work normally during air transport or in high altitude localities.

BRIEF DESCRIPTION OF THE DRAWINGS

For a better understanding of the invention and to show how it may be carried into effect, reference will now be made, purely by way of example, to the accompanying drawings.

With specific reference now to the drawings in detail, it is stressed that the particulars shown are by way of example and for purposes of illustrative discussion of selected embodiments of the present invention only, and are presented in the cause of providing what is believed to be the most useful and readily understood description of the principles and conceptual aspects of embodiments of the invention. In this regard, no attempt is made to show structural details in more detail than is necessary for a fundamental understanding of the embodiments; the description taken with the drawings making apparent to those skilled in the art how the several forms of the invention may be embodied in practice. In the accompanying drawings.

DETAILED DESCRIPTION OF THE INVENTION

Figure 1:
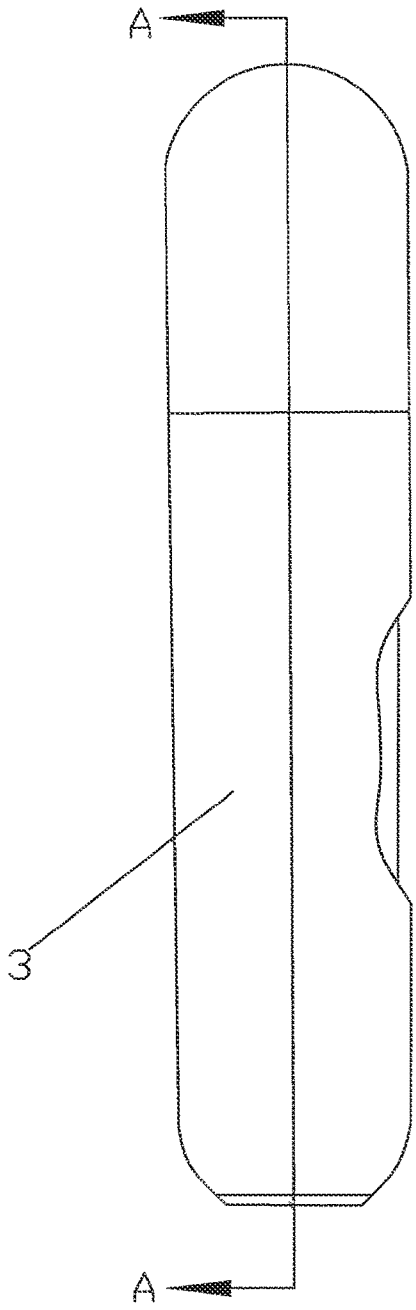
FIG. 1 is the left view of one embodiment.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

In discussion of the various figures described herein below, like numbers refer to like parts (if using numbers).

For clarity, non-essential elements were omitted from some of the drawings.

It should be understood that the various embodiments are not limited to the arrangements and instrumentality shown in the drawings.

Figure 2:
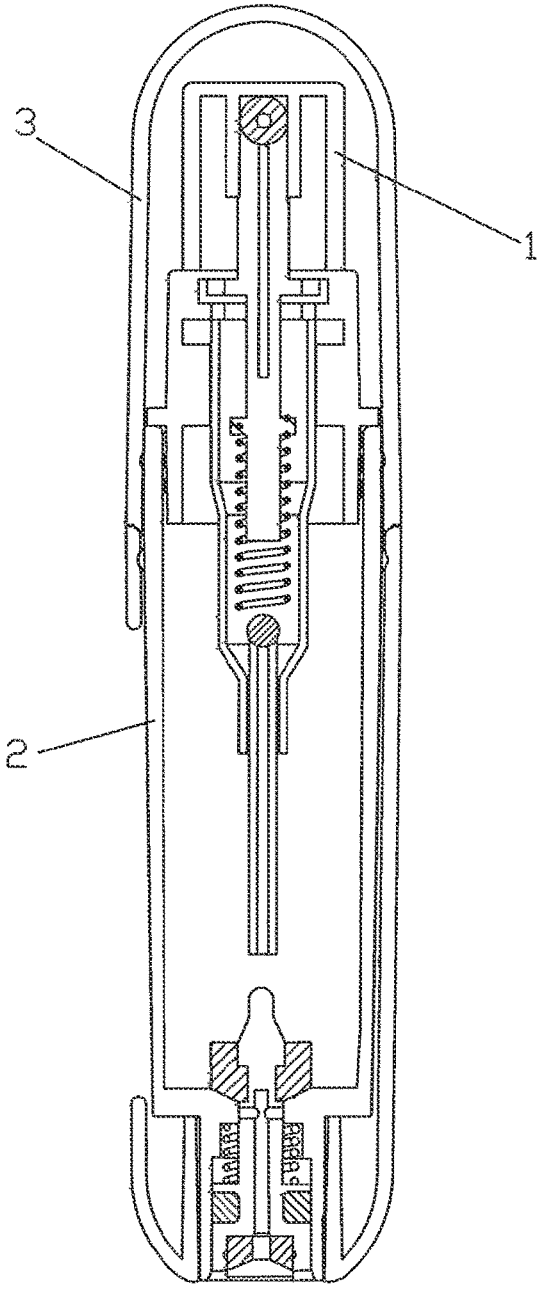
FIG. 2 is the sectional view of A-A in FIG. 1.
Figure 3:
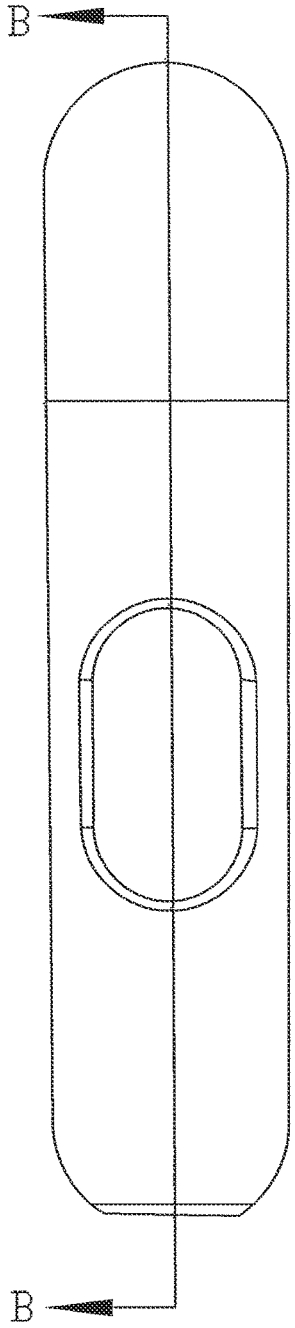
FIG. 3 is the front view of the embodiment.

The present invention comprises a dispensing mechanism such as a roll-on assembly or a nozzle assembly 1 and a bottle 2, wherein the pressing nozzle is equipped in nozzle assembly 1, including the nozzle used in the bottle of scent, shampoo, gel and medical liquid for example. It is unnecessary to give details about the structural principles. The nozzle assembly 1 is installed in the upper mouth of the bottle 2 and is connected through reverse buckling or thread. They are closely fitted, so it is easy and fast to assembly them. Obviously, it is possible to use other connection modes in other embodiments. Moreover, to give a aesthetic perception, the bottle 2 can be equipped together with the decorative enclosure 3 (FIGS. 1 to 3).

Figure 5:
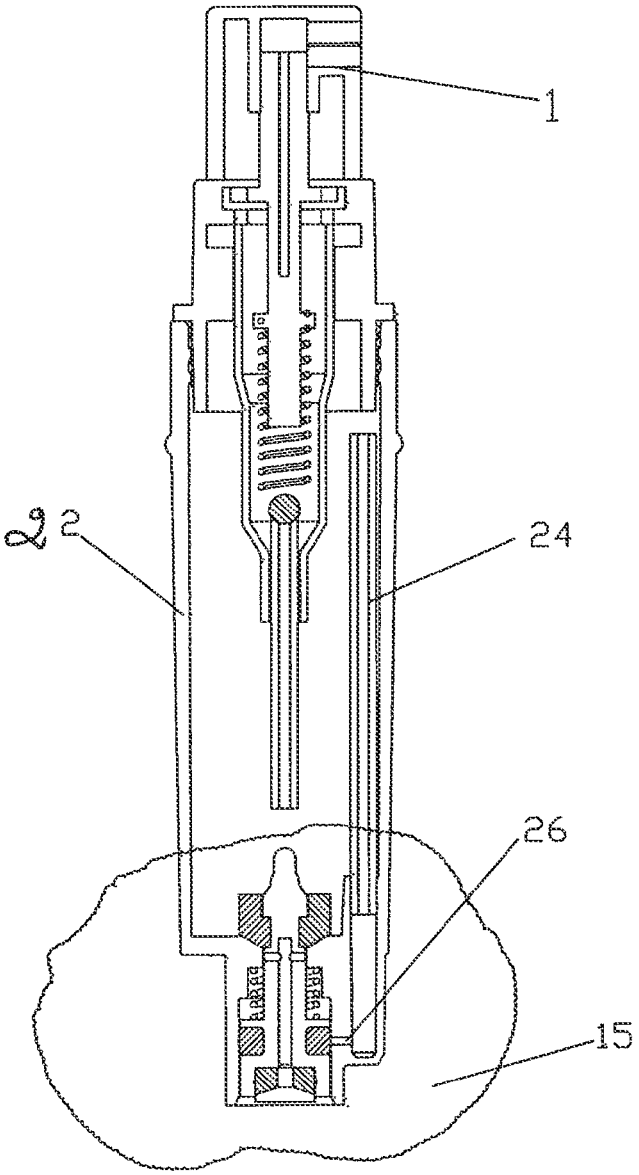
FIG. 5 is the schematic view of yet another embodiment.
Figure 6:
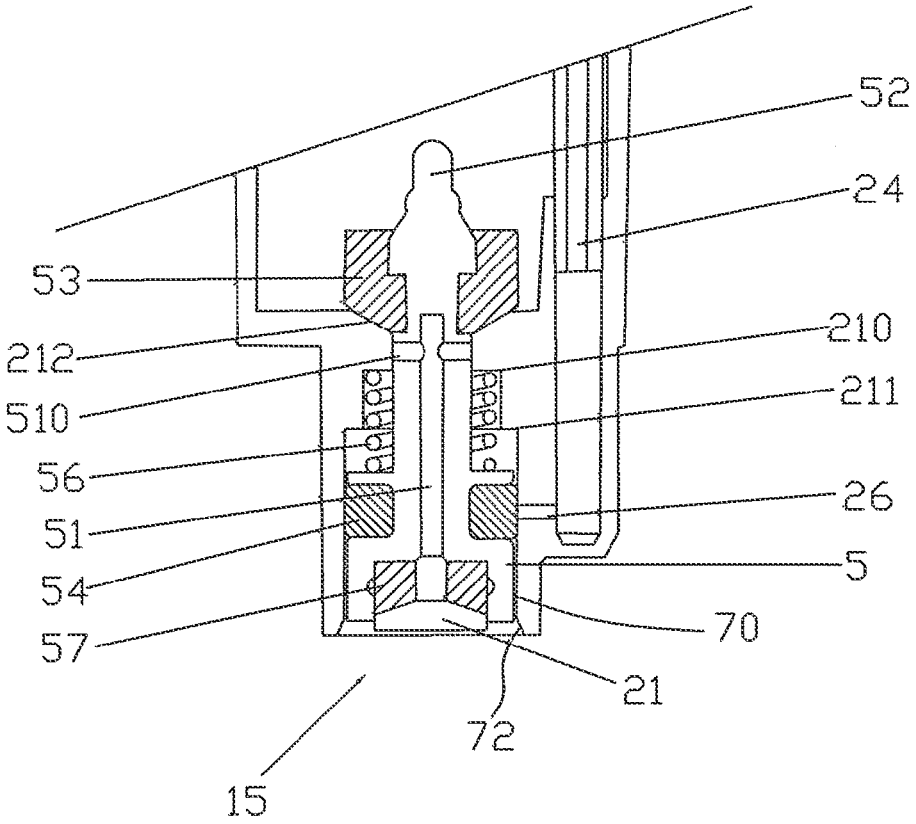
FIG. 6 is the partial amplified view of part 15 in FIG. 5.

In one embodiment, shown in FIGS. 5-6, a bare stepped liquid charging mouth 21 is equipped at the bottom of bottle 22. The liquid charging mouth 21 is fitted with a piston 5 in which a liquid charging passage 51 is installed. The opening 510 of liquid charging passage 51 is located on the top of piston 5. A stop block 52 with one flared end is equipped on the top of piston 5. The first sealing ring 53 capable of performing static sealing is arranged on the stop block 52 and seals the 22 and liquid charging mouth 21 when out of charging. The protuberant piston 5 is equipped on the stepped liquid charging mouth 21 and is provided with a compression spring 56. The compression spring 56 is equipped between the first step surface 210 of stepped liquid charging mouth 21 and stop block 52. The piston 5 is pushed downwards by the spring 56. Then the stop block 52 is driven to compress the first sealing ring 53 to perform static sealing towards bottle 22. The piston 5 is provided with a groove in between its bottom and the stop block 52, in which the second sealing ring 54 is equipped. The bottom of piston 5 is designed as a concave surface on which the third sealing ring 57 used to prevent liquid from leaking during liquid charging is equipped. Furthermore, the liquid charging structure can adopt other modes, such as the liquid charging structure sealed by bead, as shown in FIG. 7, and one sealed by silicon rubber, as shown in FIG. 8.

Figure 7:
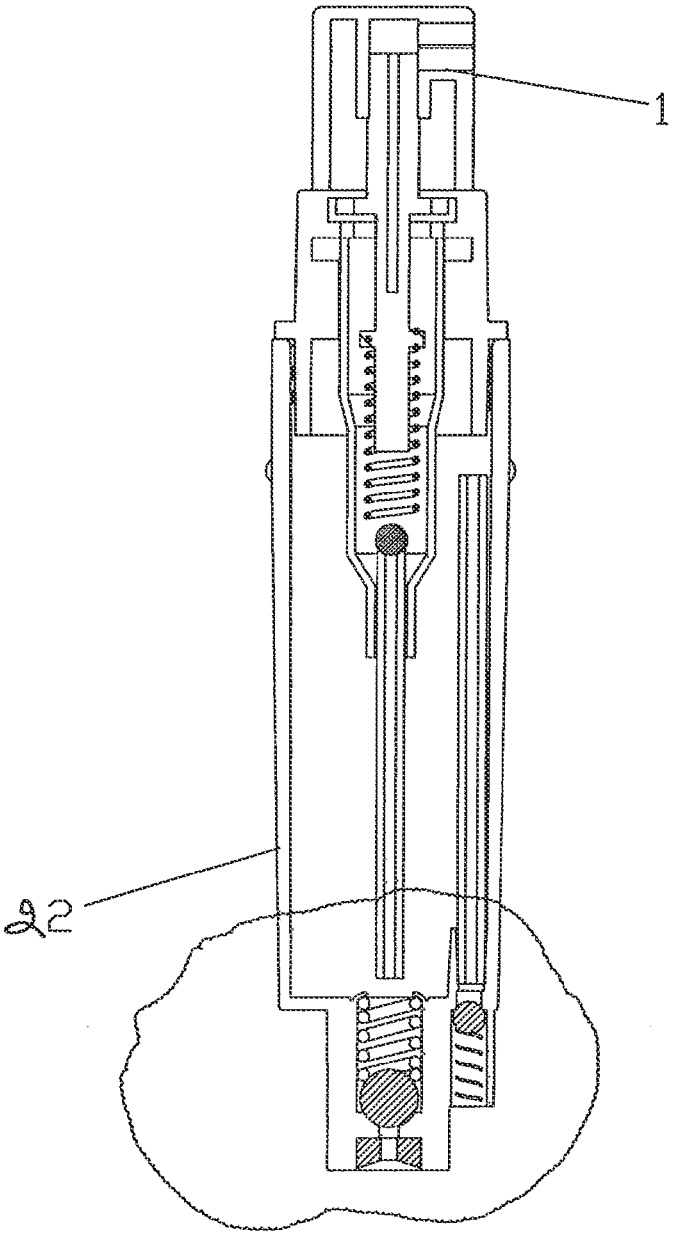
FIG. 7 is schematic view of liquid charging structure sealed by a bead.

The filling mechanism in the embodiment shown in FIG. 7 includes a liquid charging mouth and a seal. The mechanism itself includes a spring and a bead, preferably made of or coated with a material, which does not attract the liquid. The spring urges the bead downward and seals off the interior of the bottle 22 from the charging mouth. When filling the bottle 22, the bead is elevated, no longer blocking the charging mouth and lets the liquid into the bottle 22.

Figure 8:
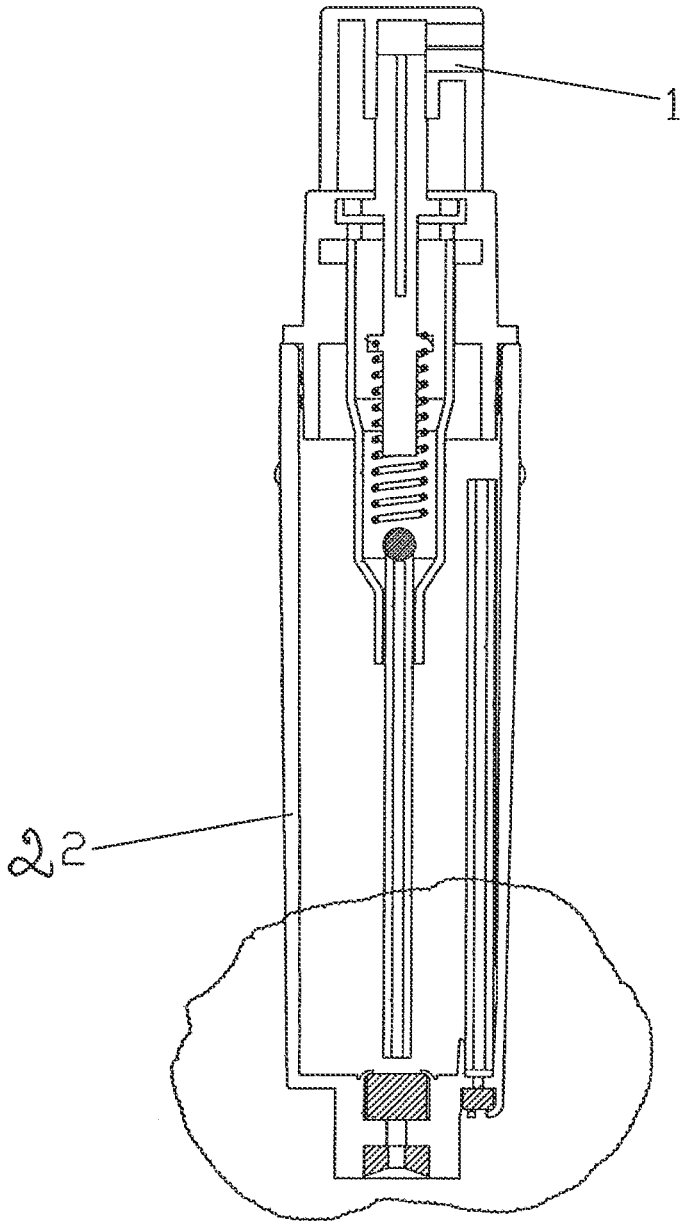
FIG. 8 is schematic view of liquid charging structure sealed by a silicon rubber gasket.

The filling mechanism in the embodiment shown in FIG. 8 includes a piston which may consist of a bottom pliable and resilient part (not shown) and a top hard part (not shown) to which the bottom part is permanently attached. The pliable and resilient part, when not forced upward, seals off the interior of the 22 from the charging mouth; when forced upward, the bottom part is compressed, and thus liquid may enter the bottle via at least one gap between the piston and a wall of the bottle defining the charging mouth. The bottom part may be made of a soft and resilient polymer such as a soft rubber, or sponge, and the top part of a hard material such as polycarbonate.

When the spray bottle is charged, the air inside the bottle 22 is compressed, resulting in the increase of pressure. As a result, if without an exhaust structure, the failure of exhaust air will cause an obstacle to charging. As well, the spray bottle may be damaged or cannot be fully charged. To address the problem above, an exhaust structure is arranged in the bottle 22. The present invention will be further perfected in combination with the embodiments.

Embodiment 1

Figures 4A, 4B:
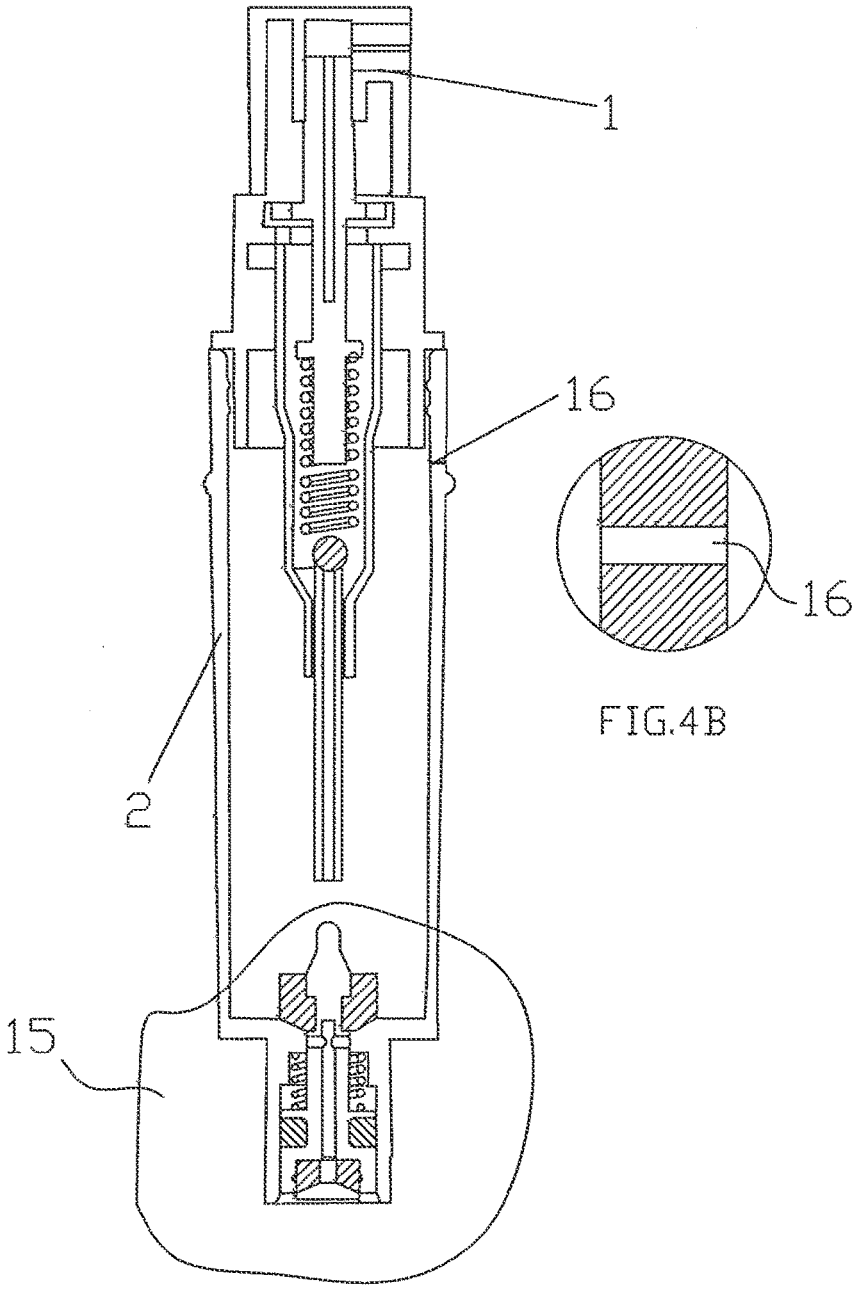
FIG. 4*a* is a sectional view of another embodiment.
FIG. 4*b* shows in exploded view an exhaust hole on a wall of the embodiment shown in FIG. 4*a;*

As shown in FIGS. 4A and 4*b*, an exhaust hole 16 is equipped on the upper part of bottle 2. The exhaust hole 16 penetrates the side wall of bottle and is interconnected with the outside. When charging, the air inside the bottle 2 is compressed, resulting in the increase of pressure. The air inside the bottle 2 is exhausted via exhaust hole 16. Since the exhaust hole 16 is interconnected with the outside and is relatively small, it is easily blocked by dust and unwanted objects. The liquid in the bottle may flow out through exhaust hole 16 due to air pressure in an airplane or localities with high air pressure, so other embodiments will be stated as below.

Embodiment 2

As shown in FIGS. 5 and 6, an exhaust hole 26 is equipped on the lower part of bottle 22 and corresponds to the groove of piston 5. An air duct 24 is interconnected with exhaust hole 26 and extends to the upper part of the bottle 22. Accordingly, the air in the bottle 22 can be exhausted through air duct 24 and exhaust hole 26. The dynamic sealing is formed by the second sealing ring 54 in the groove at the bottom of piston 5 and exhaust hole 26. That is, when charging, the second sealing ring 54 moves upwards driven by the piston and separates from exhaust hole 16, so that, the air duct 24 is directly connected with atmosphere; the second sealing ring 54 is compressed in the exhaust hole 26 in normal status, and the air duct 24 is blocked from atmosphere, thus forming sealing. Obviously, the simultaneous use can be carried out for Embodiment 1 and 2. That is to say, the exhaust hole 16 and 26 can coexist in the bottle 22.

Embodiment 3

Figure 9:
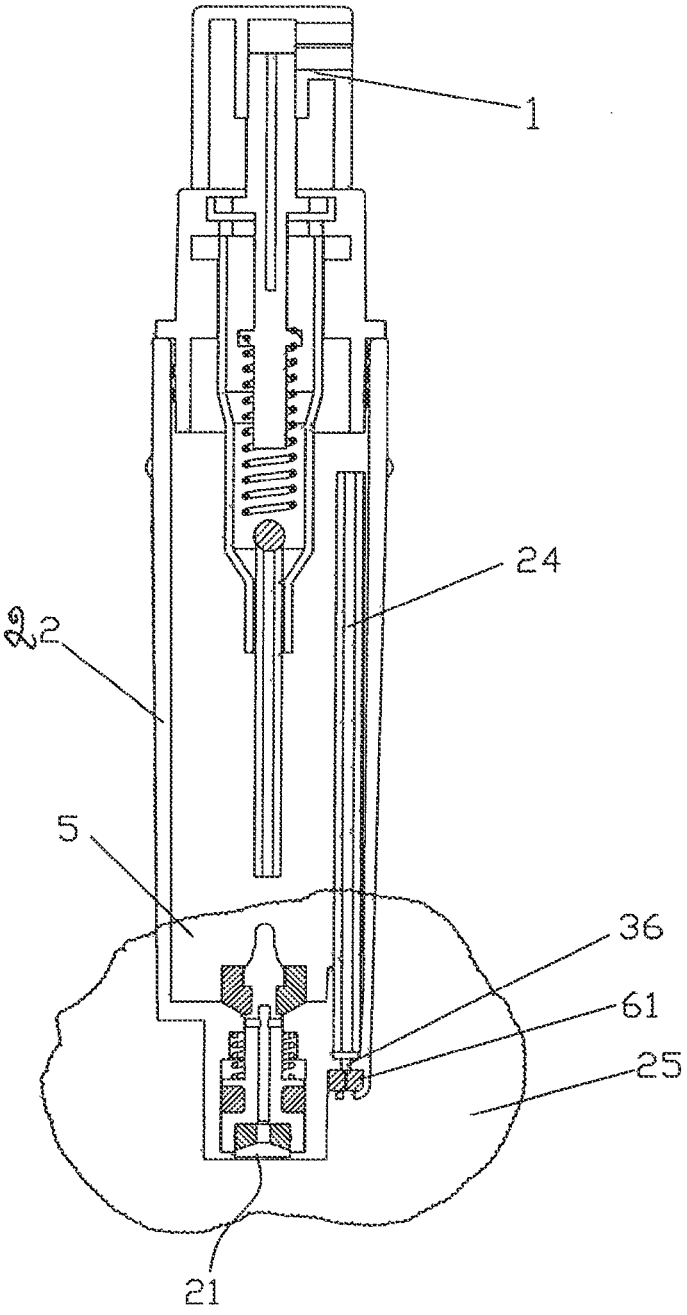
FIG. 9 is the schematic view of another embodiment.
Figure 10:
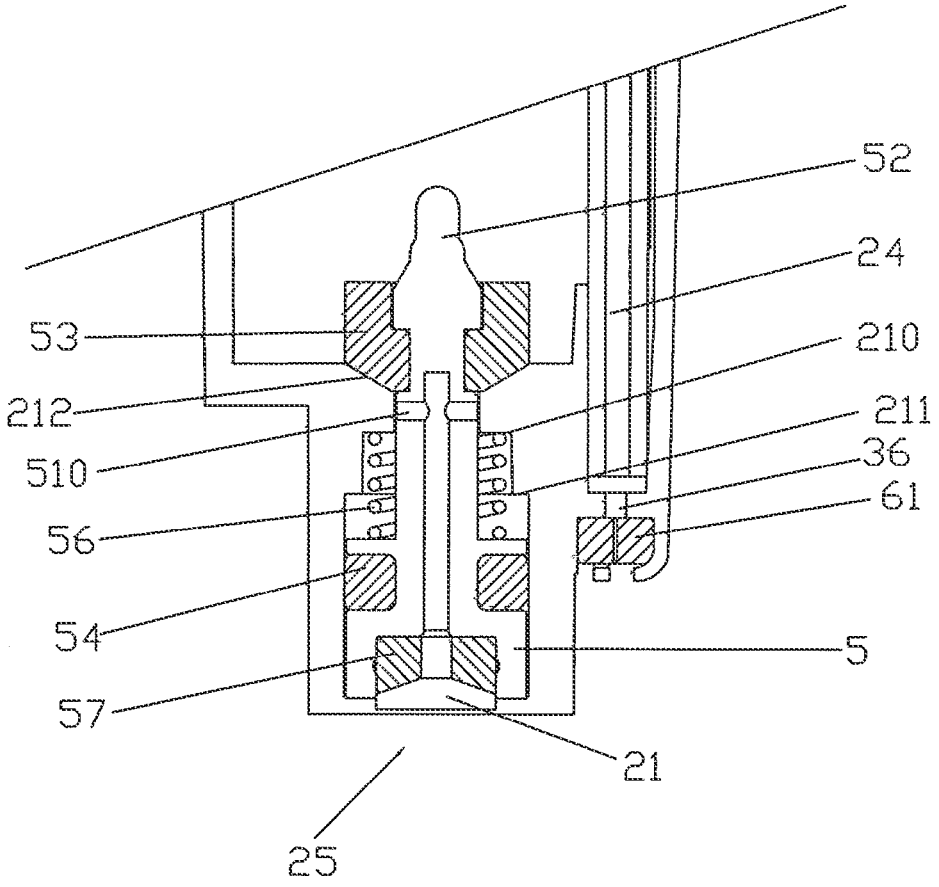
FIG. 10 is the partial amplified view of part 25 in FIG. 7.
Figures 11A, 11B:
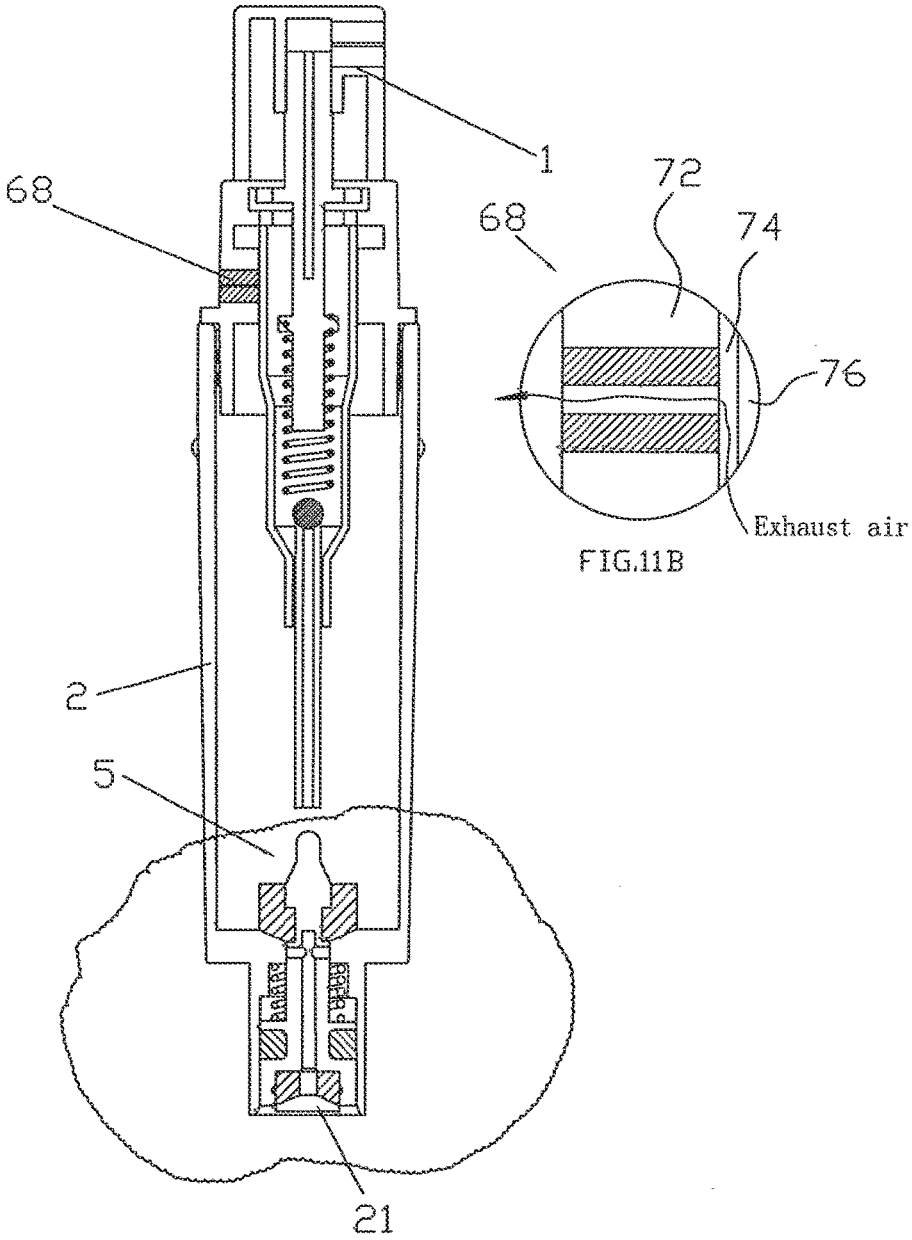
FIG. 11A is the schematic view of realization mode of yet another Embodiment.
FIG. 11B is an exploded view of part of a nozzle assembly in the embodiment shown in FIG. 11A, that includes an exhaust gasket.

As shown in FIGS. 9 and 10, Embodiment 3 differs from Embodiment 2 in arrangement of exhaust hole. In the realization mode 1 of this embodiment, an exhaust hole 36 is equipped on the lower part of bottle 22 and interconnected with the air duct 24 extending to upper part of bottle 22. A silicon rubber gasket 61 is equipped at the bottom of the exhaust hole 36 and is provided with various pores along the axis. As shown in FIG. 11A, in another realization mode of this embodiment, a silicon rubber gasket 68 is equipped on the top of nozzle assembly 1 installed on the upper part of bottle 2, wherein various pores are arranged on the silicon rubber gasket 68 along its axis. Of course, the simultaneous use can be carried out for Embodiment 1 and 3. That is to say, the exhaust hole 16 and 36 can coexist in the bottle 2 or 22, or both the silicon rubber gasket 68 and exhaust hole 16 are set in the bottle, or the three parts coexist.

FIG. 11*b* shows in an exploded view part of the nozzle structure that includes the gasket. The nozzle structure includes a sprayer cap 72, for example a screw cap, and a pump with a pump core wall 76. Between the cap 72 and the pump core wall 76 there is a gap 74, which extends from the gasket 68 all the way to the space inside the bottle 2. Exhaust air flow can escape via the gap 74 into the pores in the gasket 68, to outside the bottle 2.

Embodiment 4

Figure 12:
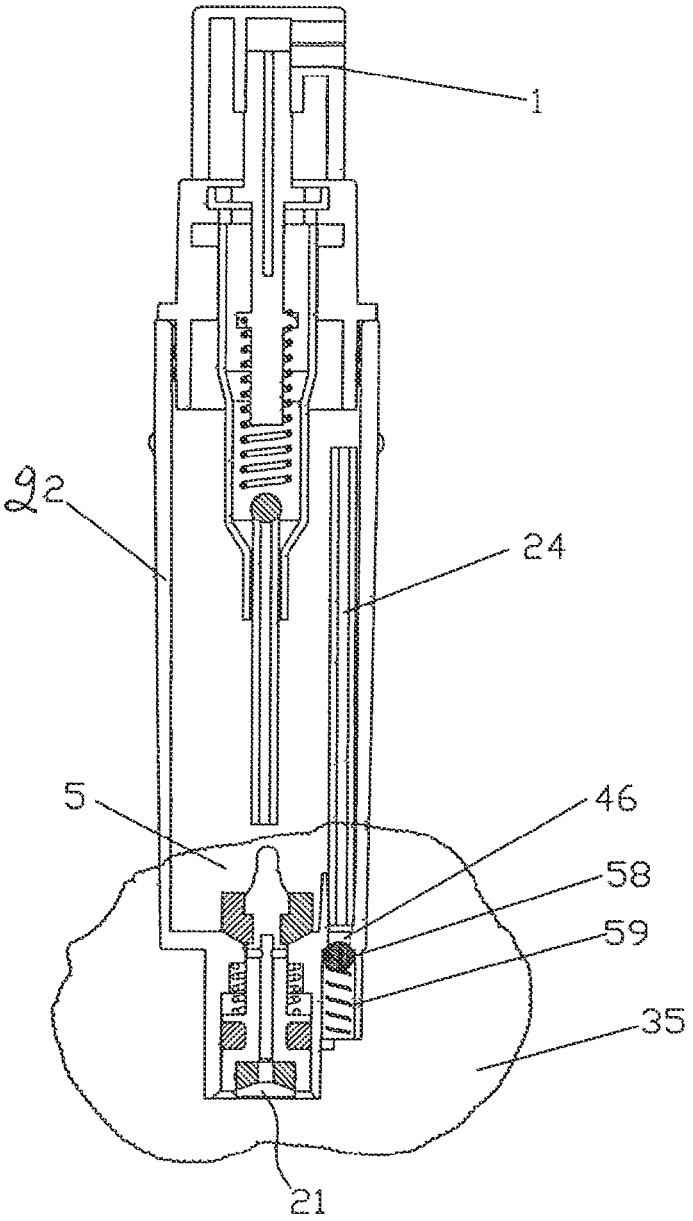
FIG. 12 is the schematic view of another embodiment.
Figure 13:
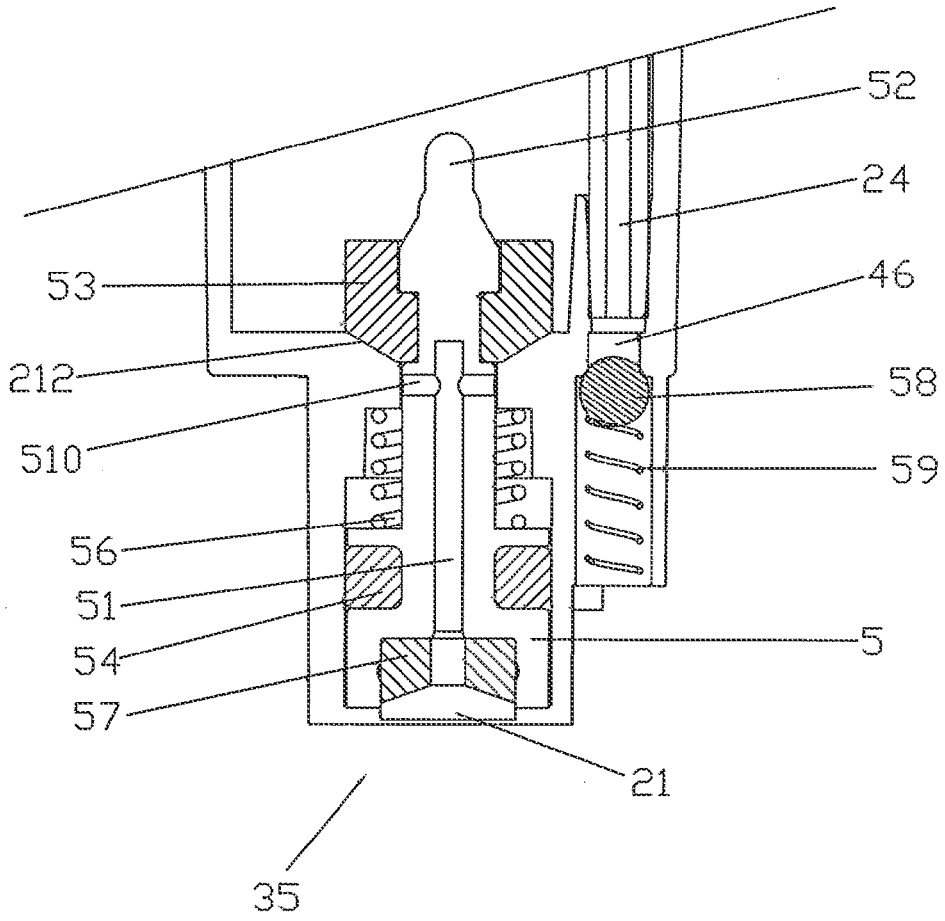
FIG. 13 is the partial amplified view of part 35 in FIG. 12.

As shown in FIGS. 12 and 13, an exhaust hole 46 is equipped on the lower part of bottle 22, and an air duct 24 is interconnected with exhaust hole 46 and extends to upper part of bottle 22. A bead 58 is equipped at the bottom of exhaust hole 46 and on the compression spring 59, wherein the compression spring 59 is set on the lower part of bottle 22. Obviously, the simultaneous use can be carried out for Embodiment 1 and 4. That is to say, the exhaust hole 16 and 46 can coexist in the bottle 22.

Figure 14:
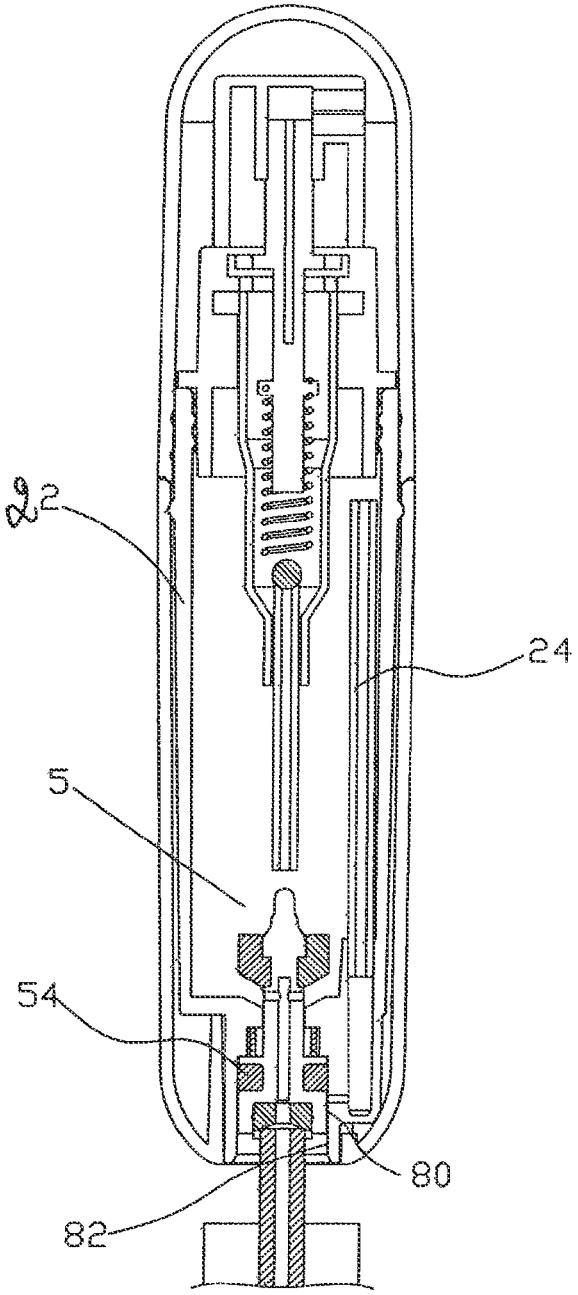
FIG. 14 is the schematic view of a liquid charging state of an embodiment of the present invention.

As shown in FIG. 14, when a spray bottle 22 is charged, the nozzle of the external large bottle is aligned with liquid charging mouth 21, thus the opening of liquid charging passage 51 of piston is aimed at the nozzle of the external large bottle. Then the spray bottle 22 is pressed down to drive the piston 5 to move upwards and compress spring 56. Furthermore, the first sealing ring 53 on the piston 5 is separated from the sloped side wall 212 on the top of liquid charging mouth 21, and bottle 22 is connected with liquid charging mouth 21, namely it is connected with liquid charging passage 51. Under certain pressure in the large bottle, the liquid in the large bottle enters liquid charging mouth 21 and then the 22 via liquid charging passage 51.

Following the liquid in the large bottle entering bottle 22, the compressed air in bottle 22 results in increased pressure, so the air is required to be exhausted so as to ensure continuous charging. In Embodiment 1, the air is drained away via exhaust hole 16.

In Embodiment 2, when charging, the second sealing ring 54 (see FIG. 6) moves upwards and separates from exhaust hole 26; the air duct 24 is directly connected with atmosphere; the air in bottle 22 is compressed, which causes the pressure to increase; the air is drained away through air duct 24 exhaust hole 26, and a gap 80 between the piston 5 and an invagination 82 of the bottle 22 in which the piston 5 is disposed.

Refer to FIG. 6, which shows that at uncharged state the sealing ring blocks the gap 70 from the duct 24: Upon stopping charging, the second sealing ring 54 moves downwards to seal exhaust hole 26. Consequently, the liquid in bottle 22 fails to flow out, and the air duct 24 is blocked from atmosphere. After the charging is finished, the nozzle of the large bottle and piston 5 are disconnected. The piston 5 can move backwards with the help of spring 56. The first sealing ring 53 arranged on stop block 52 contacts the upper part of sloped side wall 212 on the liquid charging mouth 21, thus forming sealing and completing charging.

Referring back to FIG. 5, compare the shape of the bottle body, in particular the bottom part of the bottle 22 to the shape of the bottom part of the bottle shown in FIG. 4. Note that the bottom part of the bottle 22 in FIG. 5 is somewhat wider in order to incorporate part of the exhaust structure. Another exhaust hole 26 may similarly be placed in the body, for example also at the bottom part of the bottle 22, but on an opposite side.

In the realization mode 1 of Embodiment 3, when the air inside bottle 2 is connected with silicon rubber gasket 61 which has no pores in it, the surface of silicon rubber gasket 61 is compressed to make it deform. Thus, the air can be exhausted from the circumference of the silicon rubber gasket 61. When pores are available in silicon rubber gasket 61, the air inside bottle 2 impels the pores to have a radial extension. As a result, the pores on silicon rubber gasket 61 are enlarged and the air can be drained away via exhaust hole 36. When exhaust is complete, silicon rubber gasket 61 resets to block exhaust hole 36 and seal it. In the realization mode 2 of Embodiment 3, the air inside bottle 2 impels the pores on silicon rubber gasket 68 to have a radial extension, so the air can be drained away via pores on silicon rubber gasket 68. Then, the sealing is realized when the pores of silicon rubber gasket 68 recover.

In Embodiment 4, the bead 58 compressed by air in bottle 2 impels the compression spring 59 to move downwards. The air is drained away via exhaust hole 46 when bead 58 is separated from it. With exhaust completed, the compression spring 59 supports bead 58, thus it can block the opening of exhaust hole 46 and form excellent sealing.

A variety of liquid charging structures can be used in the exhaust structure in other embodiments. As for the preferred embodiments of the present invention above, the substitutions made towards the present invention without deviating from the concept of the present invention are all within the protective scope of the present invention.

It is to be understood that the above description is intended to be illustrative, and not restrictive. For example, the above-described embodiments (and/or aspects thereof) may be used in combination with each other.

In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description.

The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

Moreover, in the following claims, the terms "first," "second," and "third," etc. are used merely as labels, and are not intended to impose numerical requirements on their objects.

This written description uses examples to disclose the various embodiments of the invention, and also to enable any person skilled in the art to practice the various embodiments of the invention, including making and using any devices or systems and performing any incorporated methods.

The patentable scope of the various embodiments of the invention is defined by the claims, and may include other examples that occur to those skilled in the art.

Such other examples are intended to be within the scope of the claims if the examples have structural elements that do not differ from the literal language of the claims, or if the examples include equivalent structural elements with insubstantial differences from the literal languages of the claims.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference.

In addition, citation or identification of any reference in this application shall not be construed as an admission that such reference is available as prior art to the present invention.

This written description uses examples to disclose the various embodiments of the invention, and also to enable any person skilled in the art to practice the various embodiments of the invention, including making and using any devices or systems and performing any incorporated methods.

What is claimed is:

1. A portable chargeable bottle comprising:

a body having an upper part and a lower part;

a dispensing mechanism provided at the upper part; and a liquid charging structure provided at the lower part;

wherein the dispensing mechanism further comprises a nozzle assembly comprising an exhaust structure having at least one exhaust hole, a sprayer cap, and a pump with a pump core wall; and wherein a gap between the cap and the pump core wall, which extends from the at least one exhaust hole to inside the portable chargeable bottle, allows exhaust air to escape via the gap and the exhaust hole to outside the portable chargeable bottle.

2. The portable chargeable bottle of claim 1, wherein said at least one exhaust hole comprises a gasket.

3. The portable chargeable bottle of claim 2, the gasket further comprising at least one pore extending therethrough, wherein pressurized air inside the bottle impels the pores to have a radial extension, such that the pores are enlarged and the pressurized air can be drained away via the at least one exhaust hole, and when exhaust is complete, the gasket resets to block and seal the at least one exhaust hole.

4. The portable chargeable bottle of claim 1, wherein said dispensing mechanism is a spray nozzle assembly.

5. The portable chargeable bottle of claim 2, wherein the gasket comprises silicon rubber.

6. The bottle of claim 1, wherein the liquid charging structure comprises:

a stepped liquid charging mouth at said bottom part;

a protuberant piston provided to the liquid charging mouth; and a resetting structure of the piston, wherein a liquid charging passage is arranged in the piston and is fitted with a discharging opening.

7. The bottle of claim 6, wherein a stop block with one flared end is provided on a top of the piston, and wherein a first sealing ring capable of performing sealing is being arranged on the stop block.

8. The bottle of claim 1, wherein the liquid charging structure comprises a liquid charging mouth at the bottom of the bottle, and a piston comprising a bottom pliable and resilient part and a top hard part to which the bottom pliable part is permanently attached, whereby the bottom pliable part, when not forced upward, seals off the interior of the bottle from the charging mouth, and when forced upward, the bottom pliable part is compressed, allowing liquid to enter the bottle via at least one gap between the piston and a wall of the bottle defining the charging mouth.

* * * * *